US009138056B2

(12) United States Patent
Kwon et al.

(10) Patent No.: US 9,138,056 B2
(45) Date of Patent: Sep. 22, 2015

(54) HOME APPLIANCE HAVING MOVABLE DOOR HANDLE

(71) Applicants: Hongsik Kwon, Seoul (KR); Youngwoo Kim, Seoul (KR); Seonil Yu, Seoul (KR)

(72) Inventors: Hongsik Kwon, Seoul (KR); Youngwoo Kim, Seoul (KR); Seonil Yu, Seoul (KR)

(73) Assignee: LG Electronics Inc., Seoul (KR)

( * ) Notice: Subject to any disclaimer, the term of this patent is extended or adjusted under 35 U.S.C. 154(b) by 214 days.

(21) Appl. No.: 13/773,160

(22) Filed: Feb. 21, 2013

(65) Prior Publication Data

US 2014/0035453 A1 Feb. 6, 2014

(30) Foreign Application Priority Data

Aug. 2, 2012 (KR) ..... 10-2012-0084830

(51) Int. Cl.

| | |
|---|---|
| ***A47B 49/00*** | (2006.01) |
| ***A47B 95/02*** | (2006.01) |
| ***E05F 11/54*** | (2006.01) |
| ***E05F 1/00*** | (2006.01) |
| *F24C 15/02* | (2006.01) |
| *E05F 1/12* | (2006.01) |
| *E05F 5/00* | (2006.01) |

(52) U.S. Cl.

CPC . *A47B 95/02* (2013.01); *E05F 1/00* (2013.01); *E05F 11/54* (2013.01); *A47B 2095/022* (2013.01); *E05F 1/1246* (2013.01); *E05F 5/00* (2013.01); *E05Y 2201/68* (2013.01); *E05Y 2900/308* (2013.01); *F24C 15/02* (2013.01); *F24C 15/024* (2013.01)

(58) Field of Classification Search

CPC A47B 2095/022; A47B 95/02; F24C 15/024; F24C 15/02; E05F 11/54

USPC ..... 312/409, 326, 328; 16/436, 438; 126/192, 197, 190, 273 R, 37 R, 39 B; 49/394

See application file for complete search history.

(56) References Cited

U.S. PATENT DOCUMENTS

| | | | | |
|---|---|---|---|---|
| 3,075,735 | A * | 1/1963 | Skinner | 248/251 |
| 2005/0023946 | A1 * | 2/2005 | Bartmann et al. | 312/328 |

FOREIGN PATENT DOCUMENTS

| | | | |
|---|---|---|---|
| EP | 2093492 | A2 * | 8/2009 |
| JP | 2005-308277 | | 11/2005 |
| KR | 10-2004-0061317 | | 7/2004 |
| KR | 10-2004-0061318 | A | 7/2004 |
| KR | 10-2004-0059678 | A | 7/2007 |

* cited by examiner

*Primary Examiner* — Daniel J Troy
*Assistant Examiner* — Andres F Gallego
(74) *Attorney, Agent, or Firm* — Dentons US LLP

(57) ABSTRACT

A home appliance having a door which may be opened and closed, and more particularly, a home appliance to assist a user in easily opening or closing a door is disclosed. The home appliance includes a cabinet having a chamber in which an object is received or retrieved, a door to open or close the chamber, and a handle assembly to be rotated relative to the door during opening or closing of the door, wherein rotation of the handle assembly causes the door to be rotated about a door rotating axis.

25 Claims, 12 Drawing Sheets

HOME APPLIANCE HAVING MOVABLE DOOR HANDLE

This application claims the benefit of Korean Patent Application No. 10-2012-0084830, filed on, Aug. 2, 2012, which is hereby incorporated by reference as if fully set forth herein.

BACKGROUND

1. Field of the Disclosure

The present disclosure relates to a home appliance having a door, and more particularly to a home appliance to assist a user in easily opening or closing a door.

2. Background

Home appliances may refer to products that perform a variety of functions using electricity or other energy at home or indoors.

Examples of home appliances may include a washing apparatus for washing or drying laundry, a refrigerator for keeping food at a refrigerating or freezing temperature, a dishwasher for washing dishes, and gas or electric ovens or microwave ovens for cooking food. In addition to the aforementioned examples, various other types of home appliances may be present.

In many cases, home appliances may include a cabinet defining the external appearance of the home appliance. In turn, a chamber in which an object is received may be defined in the cabinet. Thus, the cabinet may define the chamber.

For example, the chamber may be configured into various shapes according to the types or purposes thereof, such as a space for cooking food, a space for washing laundry, a space for storage or processing of clothes, a space for washing dishes, or a space for storage of food. Also, the chamber may be referred to by various names according to the purpose or usage of the home appliance.

The home appliances may include a door configured to be opened or closed for the ingress or egress of an object. The door may be provided with a handle to assist a user in opening or closing the door by gripping the handle with the hand.

As the capacity of the home appliance, i.e. the capacity of the chamber increases, the size of the door increases, which problematically results in the increase in the weight of the door. Therefore, there is a need to assist the user in easily opening or closing the door using the handle despite the size and weight of the door, for the sake of enhanced user convenience.

FIG. 1 illustrates a conventional oven or dishwasher home appliance. In the illustrated conventional oven or dishwasher, a handle 40 is provided at an upper portion of a front surface of a door 30, and door 30 is opened or closed via pivotal rotation thereof about a pivot center at the bottom of door 30.

To open or close door 30, the user has to grip and pull handle 40 provided at a front surface of door 30, and simultaneously apply downward force to handle 40. This type of door may be referred to as a pull-down type door. Here, handle 40 is fixed to door 30.

In many cases, as illustrated in FIG. 1, when opening the door 30, a user "a" will grip handle 40 with at least one hand such that the back of a hand "b" faces upward. In this case, the wrist of the user will inevitably be bent as door 30 is opened, and the back of the hand "b" may potentially be pushed by an upper edge 30*a* of door 30. Although changing a hand's posture of gripping handle 40 in the course of opening door 30 may eliminate this discomfort, this is not easy because it is necessary to inconveniently change from the hand that has already gripped handle 40 to the other hand.

On the other hand, the user may open door 30 by gripping handle 40 with the hand such that the palm faces upward. However, even in this case, the wrist of the user will similarly be bent and the wrist or the palm may potentially be pushed by the edge 30*a*.

As illustrated in FIG. 1, handle 40 deviates from the visual field of the user when door 30 is rotated and opened past some position. For example, when door 30 is rotated by 90 degrees and is completely opened, the user cannot see handle 40 and this makes it inconvenient for the user to grip handle 40 when closing door 30.

In particular, in the case of opening or closing the door using the above-described handle, use of the handle is not easy because the user must move various joints and muscles, such as the wrist, the arm, the knee, or the shoulder, for example. Additionally, since an increase in the capacity of home appliances results in an increase in the size and weight of the door, user inconvenience caused by the opening or closing of the door may be further increased.

For this reason, there is a need for provision of convenient home appliances that adopt an ergonomic handle design to minimize labor and discomfort of the user when opening or closing the door.

SUMMARY

Embodiments of the present invention are directed to a home appliance having a movable door handle that substantially obviates one or more problems due to limitations and disadvantages of the related art.

One object is to solve the above-described problems of the home appliance.

Through at least one embodiment of the present invention, one object is to provide a home appliance, which can prevent a handle from deviating from the visual field of a user when opening or closing a door, resulting in enhanced user convenience when the user opens and then closes the door.

Through at least one embodiment of the present invention, another object is to provide a home appliance, which can prevent the wrist of a user from being bent when opening or closing a door, and consequently prevent the back of the hand or the wrist of the user from being pushed by an edge of the door, resulting in enhanced user convenience.

Through at least one embodiment of the present invention, another object is to provide a home appliance in which a handle's position is variable as a door is rotated, which can eliminate a need for a user to change a hand's posture of gripping the handle in the course of opening or closing the door, resulting in enhanced user convenience.

Through at least one embodiment of the present invention, another object is to provide a home appliance feature, which can be easily applied regardless of the opening or closing type of a door, resulting in easy manufacture and enhanced user convenience.

Through at least one embodiment of the present invention, another object is to provide a home appliance in which a handle is movable dependent on and proportional to rotation of a door, which can prevent a user from confusing opening or closing of the door with movement of the handle.

Through at least one embodiment of the present invention, another object is to provide a home appliance, which can prevent occurrence of accidents when opening or closing a door by assisting a user in continuously applying minimum force through a handle when opening or closing the door.

Through at least one embodiment of the present invention, a further object is to provide a home appliance, which can provide a handle with a greater moment distance required to rotate and opening or close a door relative to a conventional handle, thereby assisting a user in more easily opening or closing the door.

Additional advantages, objects, and features will be set forth in part in the description which follows and in part will become apparent to those having ordinary skill in the art upon examination of the following or may be learned from practice of the invention. The objectives and other advantages may be realized and attained by the structure particularly pointed out in the written description and claims hereof as well as the appended drawings.

To achieve these objects and other advantages, as embodied and broadly described herein, a home appliance includes a cabinet defining an external appearance of the home appliance, wherein the cabinet includes a chamber in which an object is received or retrieved, a door to be rotated about a door rotating axis so as to selectively communicate the chamber with the outside, and a handle assembly connected to the door to assist a user in opening or closing the door, wherein the handle assembly includes a handle, a position of which relative to the door is variable according to an opening angle of the door in linkage with rotation of the door.

In accordance with another aspect, a home appliance includes a cabinet having a chamber in which an object is received or retrieved, a door to open or close the chamber, and a handle assembly rotated relative to the door during opening or closing of the door, wherein rotation of the handle assembly causes the door to be rotated about a door rotating axis.

The handle assembly may include a handle connected to the door to assist a user in opening or closing the door such that a position of the handle relative to the door is variable in linkage with rotation of the door.

The handle assembly may include a handle connected to the door to assist a user in opening or closing the door such that a rotation angle of the door is changed as an angle of the handle relative to the door is changed.

More specifically, rotation of the handle may be linked with rotation of the door. In other words, rotation of the handle may cause rotation of the door. Conversely, rotation of the door may cause rotation of the handle.

If force is initially applied to the handle to open the door, the door is opened. Thus, it can be said that rotation of the handle causes rotation of the door. However, as the door is opened, opening force gradually increases due to the weight of the door. Accordingly, in this case, in order to prevent rapid opening of the door, force may be applied to the handle in an opposite door closing direction. As such, once the door has been opened to some extent, rotation of the handle may be caused by rotation of the door.

The home appliance may be an oven or a dishwasher. The home appliance may also be a refrigerator, a refresher, or a washing machine.

The door may be a pull-up type door configured to upwardly rotate and open the door, or a pull-down type door configured to downwardly rotate and open the door. Also, the door may be a pull-to-the-side type door. The door type may be changed in various ways according to the kinds of home appliances.

For example, in the case of a home appliance such as a dishwasher or an oven, a pull-up type door or a pull-down type door may be provided. In the case of a home appliance such as a refrigerator or a washing machine, a pull-to-the-side type door may be provided.

The handle assembly may further include a link unit connected to the handle, the link unit serving to transmit a rotation angle or rotation force of the door to the handle in linkage with rotation of the door.

The handle assembly may further include a link unit to transmit a rotation angle or rotation force of the handle to the door in linkage with rotation of the handle.

The link unit may include a handle link configured to rotate along with the handle, and a link rotating axis defining a rotation center about which the handle link is rotated. The handle link and the link rotating axis may be integrally formed with each other.

The rotation angle of the handle may increase as an opening angle of the door increases.

The handle may be provided outside of a front surface of the door, and the link rotating axis is provided inside of the door, whereby a length of the handle link outwardly exposed from the door increases as the opening angle of the door increases.

The handle assembly may further include a link cover configured to cover an exposed portion of the handle link.

The handle link may include a first connector extending from the link rotating axis rearward of the door, a second connector extending from the first connector forward of the door to thereby be connected to the handle, and a third connector located between the first connector and the second connector.

The handle link may include an upper horizontal portion extending from the link rotating axis rearward of the door so as to be horizontally oriented substantially parallel to the handle, a vertical portion extending downward from the upper horizontal portion so as to define a vertical distance between the upper horizontal portion and the handle, and a lower horizontal portion extending forward from the vertical portion so as to be connected at one end thereof to the handle.

Here, the upper horizontal portion may correspond to the first connector, the lower horizontal portion may correspond to the second connector, and the vertical portion may correspond to the third connector. The vertical portion and the lower horizontal portion may be continuously formed to form a single curvilinear connector.

The upper horizontal portion may define a distance between the handle and the front surface of the door in a direction perpendicular to the front surface, and the vertical portion may define a distance between the handle and the front surface of the door in a direction parallel to the door. Thus, the handle link may define vertical and horizontal ranges in which the handle can be moved away from the front surface of the door.

The door may be rotatable by substantially 90 degrees, and the horizontal portion may be rotatable by substantially 90 degrees on the basis of the link rotating axis.

The link unit may further include a link connector configured to rotate the handle link about the link rotating axis as the door is rotated about the door rotating axis.

The link connector may have one end connected to the handle link and the other end connected to a link connector rotating axis, whereby the link connector is rotated about the link connector rotating axis as the door is rotated.

One end of the link connector may be rotatably connected to the handle link. A portion where the link connector and the handle link are connected to each other may be referred to as a link node.

The door rotating axis may be spaced apart from a link connector rotating axis, and the handle link may be rotated to compensate for a difference between a rotation radius of the link rotating axis with respect to the door rotating axis and a rotation radius of the link rotating axis with respect to the link connector rotating axis.

In accordance with another aspect, a home appliance includes a door, wherein the door includes a front panel, a side panel and a rear panel. The door is configured to be opened or closed about a door rotating axis. The door further includes a handle assembly, wherein the handle assembly includes a handle provided in front of the door to assist a user in opening or closing the door. The handle assembly further includes a handle link configured to rotate about a link rotating axis provided inside the door as the door is rotated, the handle link serving to rotate the handle about the link rotating axis.

A horizontal distance and a vertical distance of the handle with respect to the front panel may be variable as the handle is rotated.

The front panel may have a communication aperture for entrance or exit of the handle link.

The handle assembly may further include a link connector having one end configured to be rotated about a link connector rotating axis and the other end configured to rotate the handle link as the door is rotated.

The link connector rotating axis may be spaced apart from the door rotating axis, and the handle link may be rotated to compensate for a difference between a rotation radius of the link rotating axis with respect to the door rotating axis and a rotation radius of the link rotating axis with respect to the link connector rotating axis.

The other end of the link connector may be rotatably connected to the handle link. That is, an angle between the link connector and the handle link may be changed via a link node.

The link connector may include a connection loop to prevent interference during rotation of the handle link.

The home appliance may further include a damper to alleviate shock caused upon opening or closing of the door, and the other end of the link connector may be connected to the damper.

The attitude of the handle with respect to a base of the home appliance may be fixed as the handle is rotated about the link rotating axis.

In accordance with another aspect, a home appliance includes a door, a handle provided at one side of a front surface of the door, a handle link connected to the handle and having a link rotating axis inside of the door so as to rotate the handle about the link rotating axis, and a door assembly having a link connector connected to the handle link to rotate the handle link as the door is rotated about a door rotating axis provided at the other side of the door.

The door assembly may include the door and a handle assembly. The door may include a front panel, a rear panel, and a side panel. The handle assembly may include the handle, the handle link, and the link connector.

The link connector may have one end rotatably connected to the handle link and the other end rotatably connected to a link connector rotating axis, whereby the link connector is rotated about the link connector rotating axis as the door is rotated.

The door rotating axis, the link connector rotating axis, and the link rotating axis may have fixed positions relative to the door, and a connection portion between the handle link and the link connector may be rotated about the link rotating axis as the door is rotated.

A rotation angle of the door and a rotation angle of the handle may be substantially equal to each other.

The link connector may transmit rotation force of the door to the handle link to enable rotation of the handle link.

The attitude of the handle with respect to a base of the home appliance may be fixed as the door is rotated, and the handle may deviate from the front surface of the door in a completely open state of the door.

The above-described respective embodiments may be combined in various ways so long as features of these embodiments are not contradictory or exclusive to one another.

It is to be understood that both the foregoing general description and the following detailed description are exemplary and explanatory and should not be construed as limiting the scope of the claims.

BRIEF DESCRIPTION OF THE DRAWINGS

The accompanying drawings, which are included to provide a further understanding of the disclosure and are incorporated in and constitute a part of this application, illustrate embodiment(s) of the invention and together with the description serve to explain the principles of the invention. In the drawings.

DETAILED DESCRIPTION OF THE EMBODIMENTS

Hereinafter, a home appliance according to the embodiments of the present invention will be described in detail with reference to the accompanying drawings.

Figure 1:
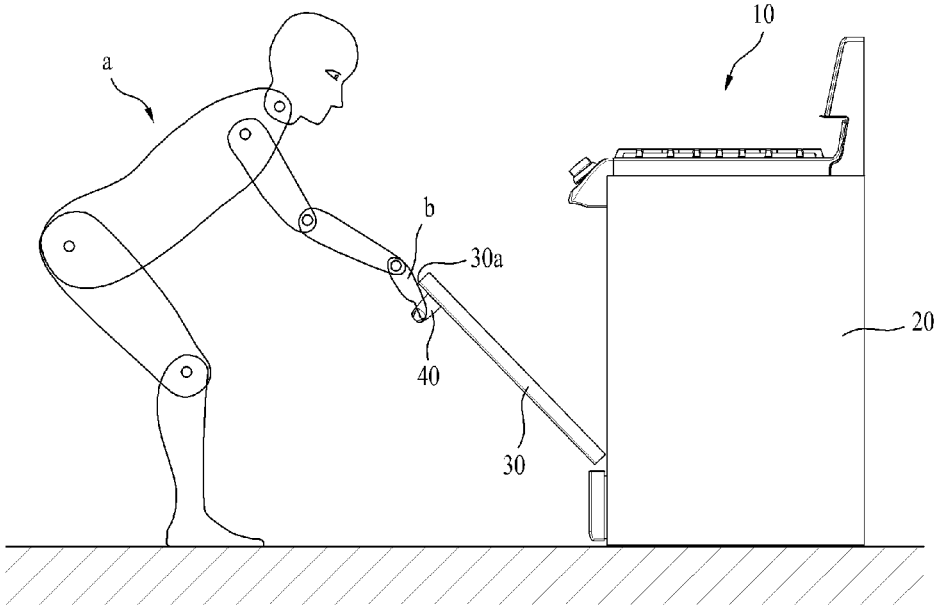
FIG. 1 Prior Art
FIG. 1 is a schematic view illustrating an opening or closing operation of a door provided in a conventional home appliance.
Figure 2:
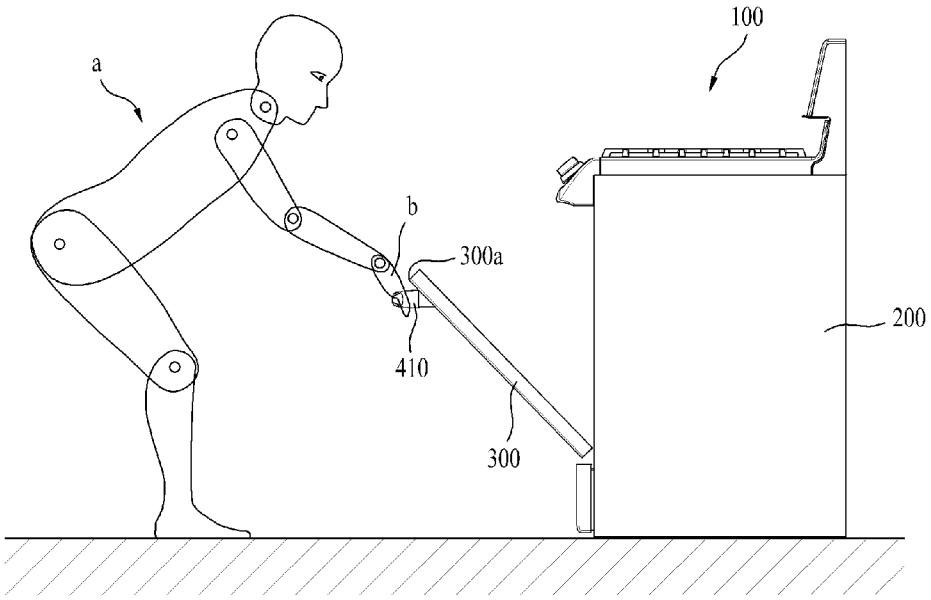
FIG. 2 is a schematic view illustrating an opening or closing operation of a door provided in a home appliance according to an embodiment of the present invention.

FIG. 2 is a schematic view of a home appliance according to an embodiment of the present invention, which is illustrated to assist recognition of differences between the home appliance illustrated in FIG. 1 and the embodiments of the present invention.

As illustrated, the home appliance, designated by reference numeral 100, according to at least one embodiment of the present invention may include a cabinet 200, a door 300, and a handle 410. Unlike handle 40 illustrated in FIG. 1, handle 410 according to the at least one embodiment is movable to or from door 300. More specifically, handle 410 is movable relative to door 300. This movement of handle 410 may be linked with an opening or closing operation of door 300.

Handle 410, unlike handle 40 illustrated in FIG. 1, may be tilted with respect to door 300. A tilt of handle 410 may vary according to a rotation angle of door 300.

Handle 410, unlike handle 40 illustrated in FIG. 1, is rotatable relative to door 300. A rotation angle of handle 410 may vary according to the rotation angle of door 300.

That is, handle 410 is variable in position relative to door 300 as door 300 is rotated, which can prevent, for example, unwanted bending of the wrist of the user, providing enhanced user convenience.

More specifically, it is preferable that the attitude of handle 410 be fixed despite rotation of door 300. That is, it is preferable that the attitude of handle 410 be fixed with respect to the floor or the base of home appliance 100.

As illustrated in FIG. 2, handle 410 may always be oriented parallel to the ground as door 300 is opened. In addition, an angle between handle 410 and a front surface of door 300 may vary according to an opening angle of door 300. In this way, it is possible to prevent the wrist of the user from being bent as door 300 is opened, and consequently, to prevent the back of the hand "b" from being pushed by a door edge 300*a*.

The opening or closing operation of door 300 and movement of handle 410 in linkage with the opening or closing operation of door 300 will be described later in detail.

Figure 3:
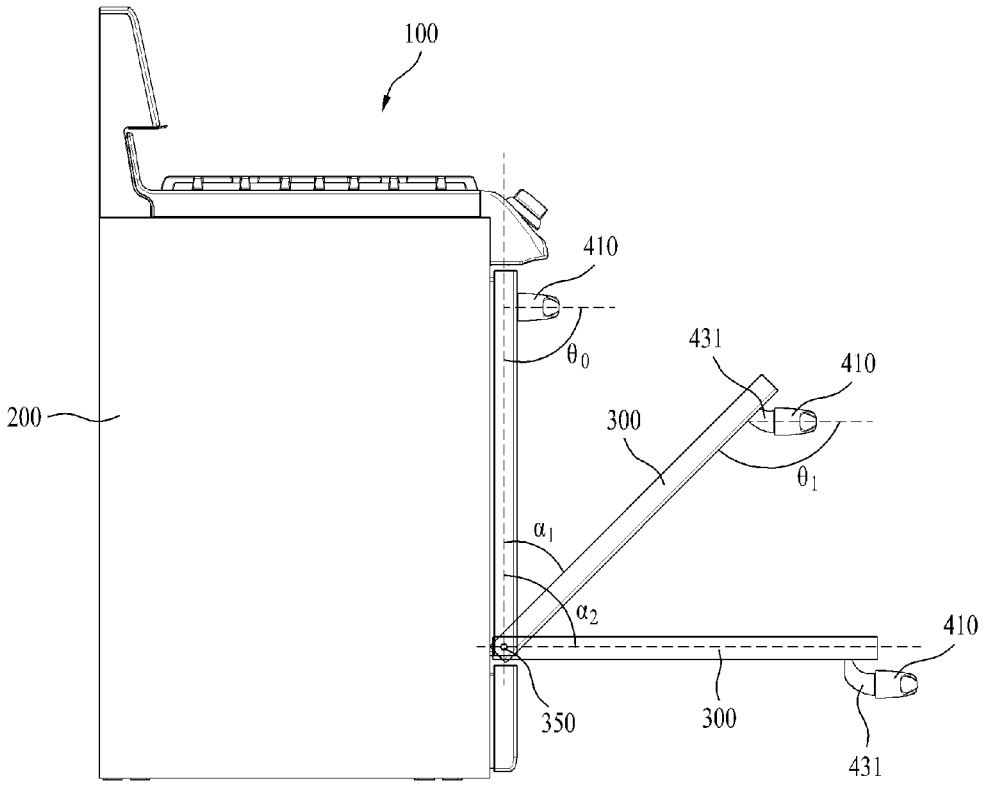
FIG. 3 is a side view illustrating the attitude of a handle depending on an opening or closing angle of the door provided in the home appliance illustrated in FIG. 2.
Figure 4:
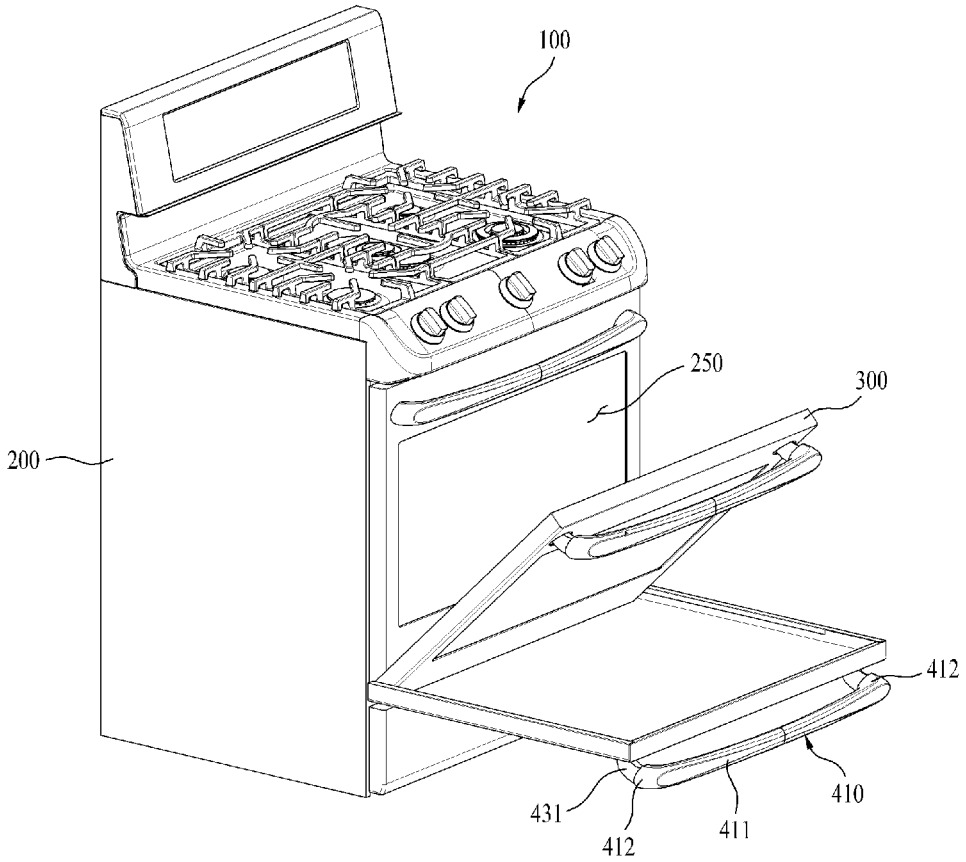
FIG. 4 is a perspective view of the home appliance illustrated in FIG. 3.

FIGS. 3 and 4 illustrate the home appliance according to another embodiment of the present invention in more detail, and also clearly illustrate variation in the position of handle 410 depending on the opening angle of door 300. In FIGS. 3 and 4, door 300 is illustrated as being originally oriented perpendicular to the floor. However, this is given only by way of example, and door 300 may be oriented at an acute angle or at an obtuse angle with respect to the floor. Also, an angle between handle 410 and the front surface of door 300 in a closed state of door 300 may be an acute angle or an obtuse angle, rather than a right angle.

As illustrated in the drawings, handle 410 may be oriented substantially perpendicular to door 300 in a closed state of door 300. Also, handle 410 may be horizontally oriented parallel to the floor or the base of home appliance 100 in the closed state of door 300.

However, it will be appreciated that handle 410 is moved away from door 300 as door 300 is rotated and opened. In other words, as door 300 is rotated and opened, a distance between the front surface of door 300 and handle 410 may increase. In addition, it will be appreciated that an angle between the front surface of door 300 and handle 410 increases as door 300 is rotated and opened. That is, it will be appreciated that a tilt angle $\theta$ of handle 410 increases. In other words, it will be appreciated that tilt angle $\theta$ of handle 410 increases as an opening angle $\alpha$ of door 300 increases. For example, it will be appreciated that tilt angle $\theta$ of handle 410 increases from $\theta_1$ to 180 degrees as the opening angle of door 300 increases from $\alpha_1$ to $\alpha_2$.

FIG. 3 illustrates an example in which $\theta$ varies from 90 degrees to 180 degrees as $\alpha$ varies from zero to 90 degrees, although embodiments of the present invention are not limited to the aforementioned angles.

More specifically, the attitude of handle 410, i.e. the attitude with respect to the floor may continuously remain, whereas the position of handle 410 relative to door 300 may be variable. Also, as door 300 is rotated and opened, handle 410 performs vertical and horizontal movement relative to door 300. This movement will be referred to as rotation of handle 410 relative to door 300.

For example, assuming that door 300 is in a closed state at an angle of 90 degrees with respect to the floor and is in a completely open state at an angle of 180 degrees with respect to the floor (i.e., parallel to the floor), it can be said that handle 410 provided at door 30 has an angle of 90 degrees with respect to door 300 in the closed state of door 300 and has an angle of 180 degrees with respect to door 300 (i.e. is parallel to door 300) in the completely open state of door 300.

As shown in FIG. 3, handle 410 is located within the range of the front surface of door 300 in the closed state of door 300. However, as door 300 is rotated, handle 410 gradually deviates from the range of the front surface of door 300. Preferably, the handle 410 completely deviates from the range of the front surface of door 300 when door 300 is rotated by 90 degrees and is completely opened.

Through the above-described movement, handle 410 continuously remains in the visual field of the user regardless of the position of door 300. In this way, it is possible to minimize bending of the wrist of the user when opening or closing door 300 and to assist the user in easily finding and gripping handle 410. This may also allow the user to operate handle 410 with less efforts.

A link unit (430, see FIG. 6) may be included between door 300 and handle 410 to enable movement of handle 410 in linkage with rotation of door 300. A detailed description of link unit 430 will follow. In FIGS. 3 and 4, a handle link 431 constituting link unit 430 is illustrated.

Link unit 430 may include a pair of handle links 431 interposed between door 300 and handle 410. More specifically, it can be said that a position of handle 410 relative to door 300 is acquired via movement of handle links 431.

As illustrated in FIG. 4, handle 410 may include a grip portion 411 that the user can grip, and leg portions 412 to maintain a basic distance between grip portion 411 and the front surface of door 300. The basic distance is required to define a space for entrance of the user's fingers. As such, the user can open door 300 by gripping handle 410 via grip portion 411 when it is desired to expose the interior of a chamber 250 defined in home appliance 100 to the outside.

Hereinafter, the embodiments of the present invention will be described in more detail with reference to FIGS. 5 to 10.

Figure 5:
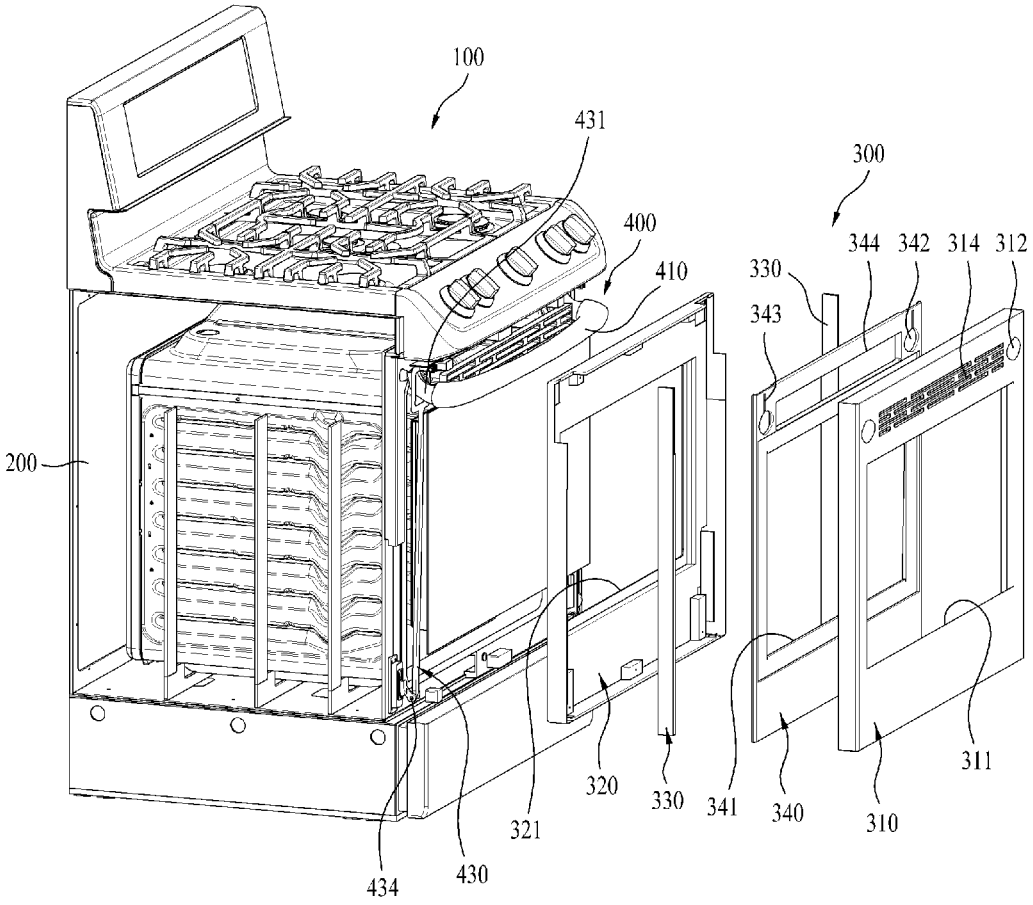
FIG. 5 is a partial exploded perspective view of a home appliance according to one embodiment of the present invention.

FIG. 5 is a partial exploded perspective view illustrating a home appliance, more particularly, an oven according to one embodiment of the present invention. In the illustrated oven, door 300 may be of a pull-down type, which is opened as the user grips handle 410 and pivotally rotates door 300 downward.

Home appliance 100 may include cabinet 200 defining the external appearance of home appliance 100. In turn, chamber 250 in which an object is received may be defined in cabinet 200. Of course, cabinet 200 may directly define chamber 250, or chamber 250 may be defined in cabinet 200 using separate structures.

Door 300 may be installed to the front of home appliance 100. If door 300 is opened, chamber 250 may communicate with the outside of home appliance 100. Accordingly, the user can put an object into chamber 250 or pull an object from chamber 250 in an open state of door 300.

Figure 7:
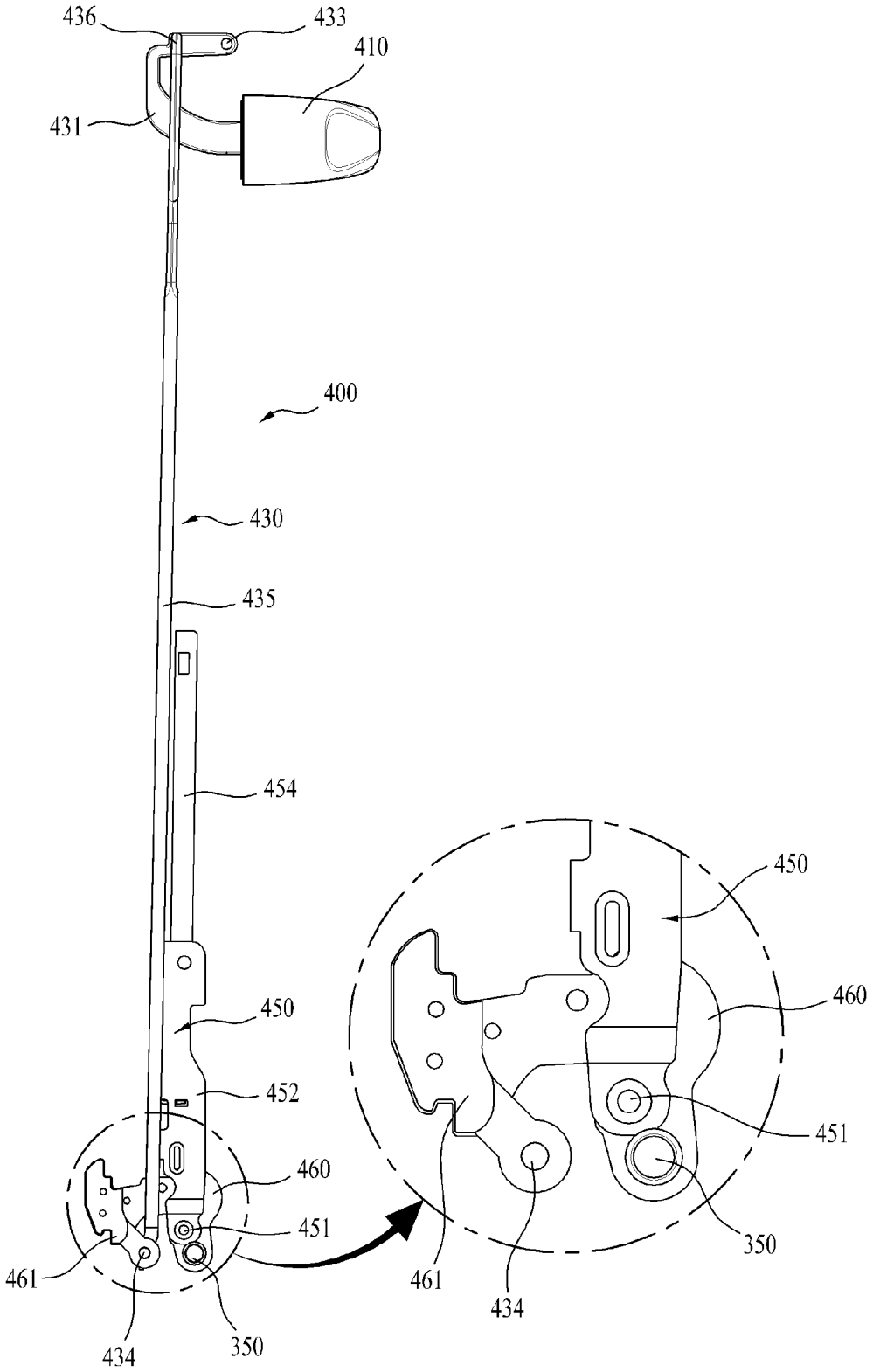
FIG. 7 is a side view of the handle and the link unit illustrated in FIG. 5.

Door 300 is installed to pivotally rotate about a door rotating axis (350, see FIG. 7). Door rotating axis 350 is preferably fixed to cabinet 200 in consideration of the weight of door 300. In other words, it is preferable to at least prevent translational movement of door rotating axis 350. As such, preferably, door 300 may perform only pivotal rotation about door rotating axis 350 without performing translational movement when opening or closing door 300.

Herein, a bracket 460 may be provided to the cabinet to form door rotating axis 350. Bracket 460 can be fixed to cabinet 200. One end of bracket 460 may be located inside the cabinet and the other end of bracket 460 may be located inside of door 300. Also, the other end of bracket 460 may be located at both sides of the door. Therefore, the door can be rotated about door rotating axis 350 provided outside of cabinet 200.

In the case of the oven, since the interior of chamber 250 is exposed to high temperatures, it is necessary to prevent interior heat of chamber 250 from being transferred to the outside through door 300 and to allow the interior of chamber 250 to be visible. To this end, door 300 may generally have a thick and complex configuration.

More specifically, door 300 may include a front panel 310, a side panel 330, and a rear panel 320. Front panel 310 and rear panel 320 may respectively have central openings 311 and 321, and in turn, openings 311 and 321 may be provided with transparent windows. As such, watching the interior of chamber 250 from the outside is possible. Side panel 330 may be fabricated separately from or integrally with front panel 310 or rear panel 320.

Door 300 may further include an intermediate panel 340 interposed between front panel 310 and rear panel 320. Similarly, intermediate panel 340 may have a central opening 341, and in turn central opening 341 may be provided with a transparent window.

As described above, the external appearance of door 300 may be defined by the plurality of panels 310, 320, 330, and 340. FIG. 5 illustrates the plurality of panels in a disassembled state. That is, for convenience of description, the plurality of panels is illustrated as being disassembled from a handle assembly 400 and cabinet 200.

Handle 410 may be located at an upper portion of the front surface of door 300, and more particularly, at an upper portion of a front surface of front panel 310. Handle 410 is connected to door 300 to assist the user in opening or closing door 300.

Door rotating axis 350 may be located at a lower portion of door 300 to correspond to the position of handle 410. In other words, if handle 410 is located at one side of door 300, door rotating axis 350 may be provided at the other side of door 300.

According to at least one embodiment of the present invention, handle 410 may be moved in linkage with rotation of door 300 such that a position of handle 410 relative to door 300 varies according to an opening angle of door 300. For example, it is preferable that displacement of handle 410 increase as the opening angle of door 300 increases.

Here, handle 410 may be an exterior element of front panel 310 of door 300. More specifically, handle 410 may be a combination of the grip portion (411, see FIG. 4) that the user directly grips with the hand and the leg portions (412, see FIG. 4) to allow grip portion 411 to be elevated outward from front panel 310. For example, grip portion 411 may be substantially parallel to front panel 310 of door 300, and leg portions 412 may protrude from both ends of grip portion 411 to connect grip portion 411 and front panel 311 to each other.

In the case of conventional handles, leg portions 412 are fixed to door 300, and thus grip portion 411 is fixed to door 300. On the other hand, handle 410 according to at least one of the present embodiments is preferably variable in position relative to door 300 according to an opening angle of door 300. Accordingly, in one embodiment, the position of handle 410 is variable in linkage with rotation of door 300.

Handle 410 may constitute handle assembly 400, and home appliance 100 according to the embodiments of the present invention may include handle assembly 400.

Elements corresponding to reference numerals 312, 342 and 343 illustrated in FIG. 5 will be described later.

Figure 6:
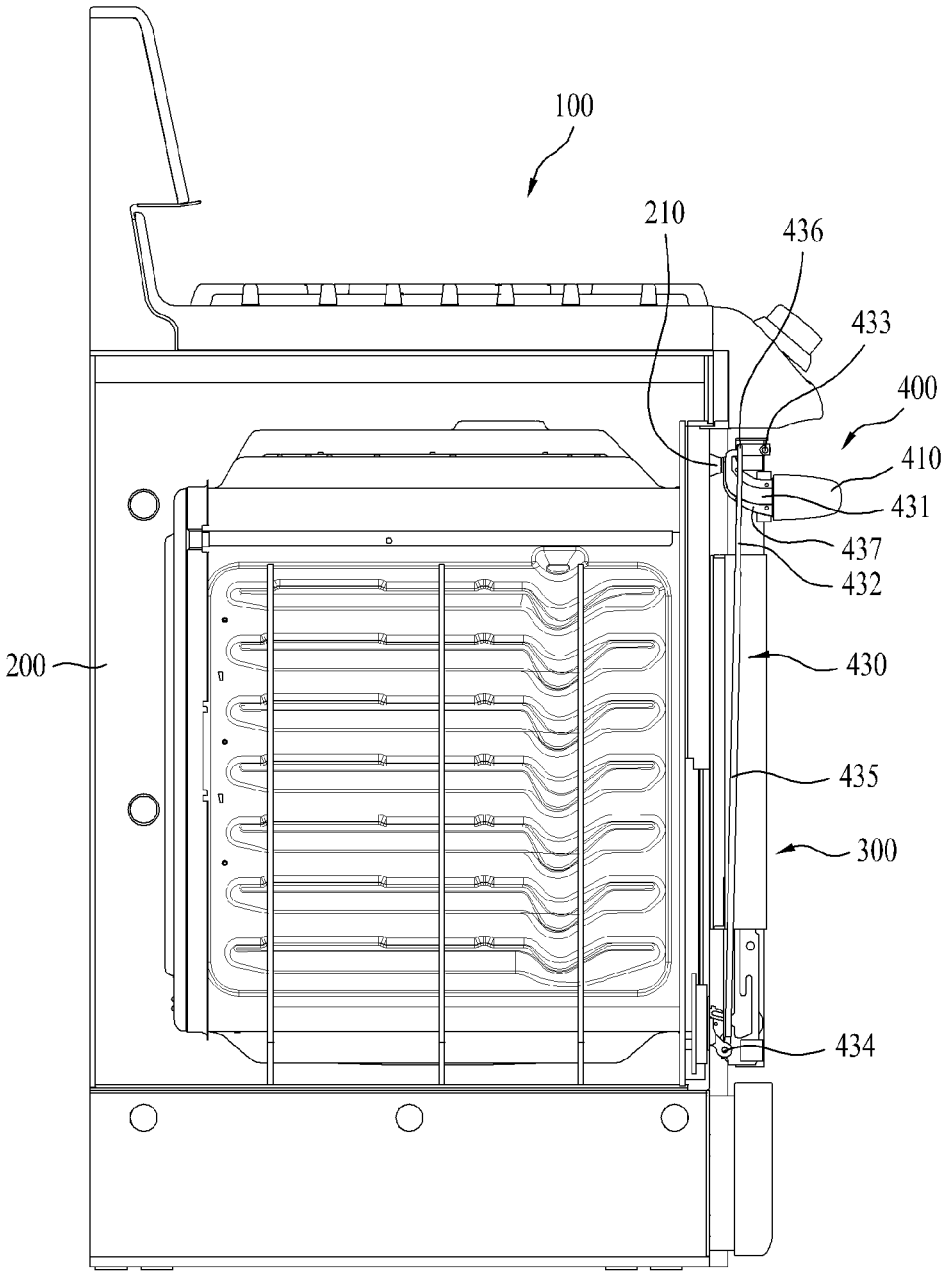
FIG. 6 is a side sectional view of the home appliance illustrated in FIG. 5.

In FIG. 6, the panels constituting door 300 are removed for clear illustration of handle assembly 400. The relation between handle 410 and link unit 430, and the relation between door rotating axis 350 and link connector rotating axis 434 are clearly disclosed.

More specifically, as shown in FIG. 6 and FIG. 7, handle assembly 400 may include handle 410 and link unit 430. Link unit 430 may be moved in linkage with rotation of door 300. Also, link unit 430 may serve to transmit a rotation angle or rotation force of door 300. Thus, link unit 430 and handle 410 are preferably connected to each other. In this way, as link unit 430 is moved in linkage with door 300, the rotation angle or rotation force of door 300 may be transmitted to handle 410 via link unit 430.

Conversely, door 300 may be rotated in linkage with movement of link unit 430. That is, link unit 430 may serve to convert rotation of handle 410 into rotation of door 300.

More specifically, link unit 430 may include handle links 431 connected respectively to the aforementioned leg portions 412 of handle 410. Of course, handle link 431 may be integrally formed with leg portion 412, and may be coupled to leg portion 412 using a fastener.

Link unit 430 may further include a link rotating axis 433 as a rotation center of handle link 431. As handle link 431 is rotated about link rotating axis 433, handle 410 is also rotatable about link rotating axis 433.

Basically, handle 410 is preferably located outside of the front surface of door 300, and link rotating axis 433 and handle link 431 are preferably located inside of door 300. For example, handle link 431 is preferably located in a space between front panel 310 and rear panel 320 of door 300. In this way, it is preferable that handle link 431 not be exposed to the outside and only handle 410 be exposed to the outside in a closed state of door 300.

However, the greater the opening angle of door 300, the greater the rotation angle of handle link 431 on the basis of link rotating axis 433, and consequently, the greater the rotation angle of handle 410. This means that handle link 431 may be exposed outward from the front surface of door 300. Accordingly, a length of handle link 431 exposed to the outside of door 300 may increase as the opening angle of door 300 increases. Also, the rotation angle of handle 410 may increase as the opening angle of door 300 increases.

In other words, at least a portion of handle link 431 may protrude outward from the front surface of door 300 via rotation thereof. To this end, as illustrated in FIG. 5, door 300 preferably has communication apertures 312 and 342 for entrance and exit of handle link 431. As described above, handle link 431 may be connected to leg portion 412 of handle 410, and therefore the communications apertures 312 and 342 may be positioned to correspond to leg portion 412.

More specifically, communication aperture 312 may be formed in front panel 310 of door 300. If intermediate panel 340 is present, intermediate panel 340 may be provided with communication aperture 342. However, rear panel 320 is preferably not provided with a communication aperture. This is because rear panel 320 may serve to prevent reverse rotation of handle link 431 in a closed state of door 300.

Handle assembly 400 or link unit 430 may include a link cover 437. Link cover 437 may be configured to enclose at least a portion of handle link 431. For example, link cover 437 may be configured to enclose the entire exposed portion of handle link 431 outside of door 300. The shape of the aforementioned communication apertures 312 and 342 may be determined to correspond to the cross sectional shape of link cover 437.

Link cover 437 may serve to provide an aesthetically pleasing exterior design. Link cover 437 may be designed to prevent handle link 431 from being exposed to the outside of door 300. Link cover 437 may also be designed to ensure smooth entrance or exit of handle link 431 via communication apertures 312 and 342. To this end, link cover 437 may have a circular cross section, and the cross sectional area of link cover 437 may gradually increase outward in a longitudinal direction thereof. In other words, the cross sectional area of link cover 437 on the basis of door 300 gradually decreases as the exposed length of link cover 437 increases. For example, it is preferable that a gap between link cover 437 and communication aperture 312 be minimized in a closed state of door 300, but gradually increase as door 300 is opened. This serves to allow link cover 437 to smoothly and continuously enter or exit communication aperture 312. Also, the minimized gap between link cover 437 and communication aperture 312 may prevent invasion of impurities through the gap.

Of course, although the size of the gap between link cover 437 and communication aperture 312 increases as door 300 is opened, door 300 usually remains in a closed state and the size of the gap has no effect on operation of home appliance 100.

Figure 10:
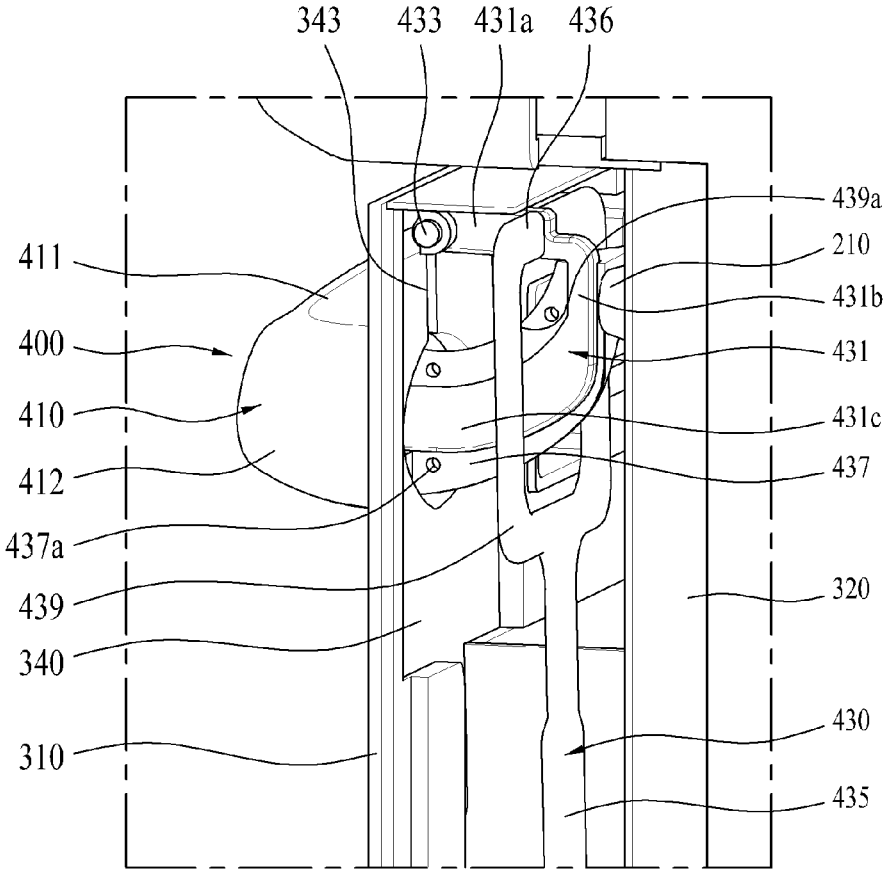
FIG. 10 is an enlarged view illustrating a handle link part illustrated in FIG. 5.

Alternatively, link cover 437 may consist of two halves coupled to each other to enclose handle link 431. To this end, as illustrated in FIG. 10, link cover 437 may have coupling holes 437*a* or coupling bosses.

As illustrated in FIG. 6 and FIG. 7, link unit 430 may further include a link connector 435. Link connector 435 may serve to transmit the rotation angle or rotation force of door 300 to handle link 431. For example, link connector 435 may serve to rotate handle link 431 about link rotating axis 433 as door 300 is rotated about door rotating axis 350.

More specifically, one end of link connector 435 may be connected to handle link 431 and the other end of link connector 435 may be connected to a link connector rotating axis 434. Link connector 435 is swung or rotated about link connector rotating axis 434 as door 300 is rotated.

Preferably, link connector rotating axis 434 is rotatably secured to cabinet 200. Preferably, one end of link connector 435 is rotatably connected to handle link 431.

Herein, a bracket 461 may be provided to the cabinet to form link connector rotating axis 434. Bracket 461 can be fixed to cabinet 200. One end of bracket 461 may be located inside the cabinet and the other end of bracket 461 may be located inside of door 300. Link connector rotating axis 434 is located behind door rotating axis 350. Therefore, it can be said that link connector rotating axis 434 is spaced apart horizontally from door rotating axis 350.

Figure 8:
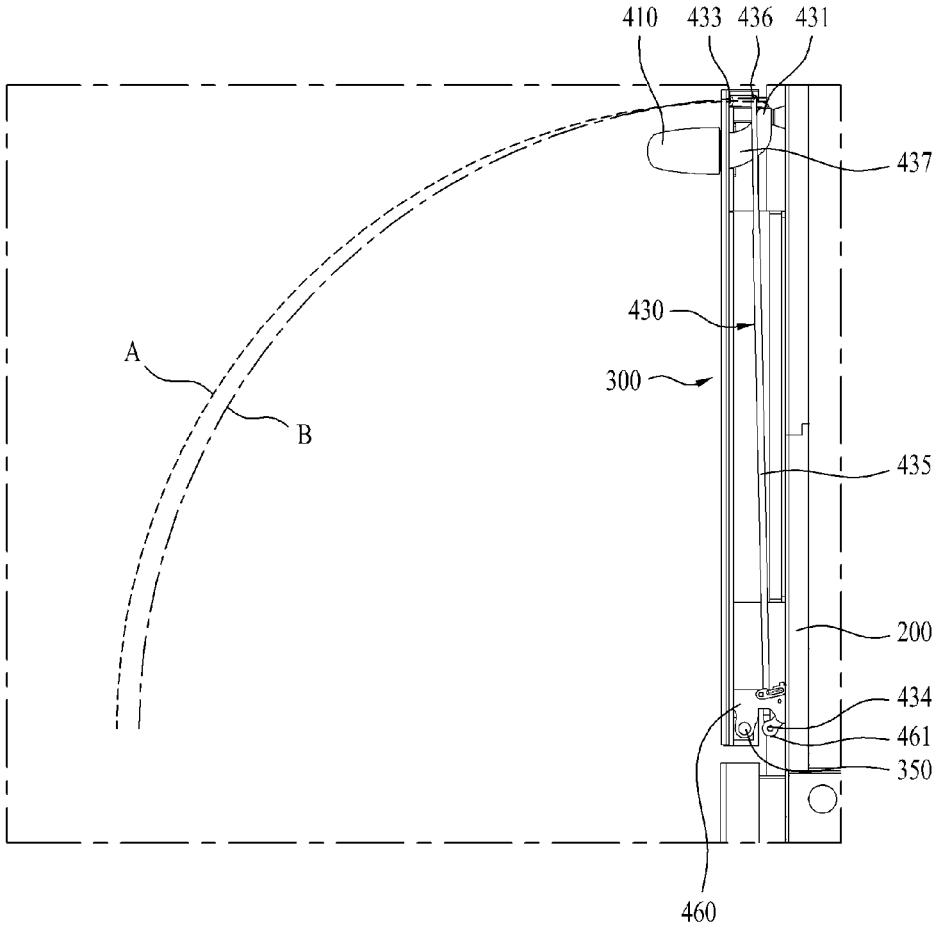
FIG. 8 is a partial sectional view illustrating a closed state of the door provided in the home appliance illustrated in FIG. 5.

As illustrated in FIG. 7 and FIG. 8, bracket 461 can be provided separately from bracket 460 which forms door rotating axis 350. Also, bracket 461 can be fixed to cabinet 200 with bracket 460. However, it may be possible to form a single bracket for forming both the door rotating axis and the link connector rotating axis. In any case, it is desirable to locate bracket 461 to an inner side of bracket 460 in door 200.

A location where link connector 435 and handle link 431 are connected to each other may be referred to as a link node 436. Link node 436 may perform translational movement inside of door 300. Of course, a movement trajectory of link node 436 may be dependent on a movement trajectory of link connector 435 and handle link 431.

Here, the positional difference between link connector rotating axis 434 and door rotating axis 350 may be the same with the positional (horizontal and vertical) difference between node 436 of handle link 431 and link rotating axis 433 when the door is closed.

Other elements including an element corresponding to reference numeral 210, which is illustrated in FIG. 6, will be described later.

Figure 9:
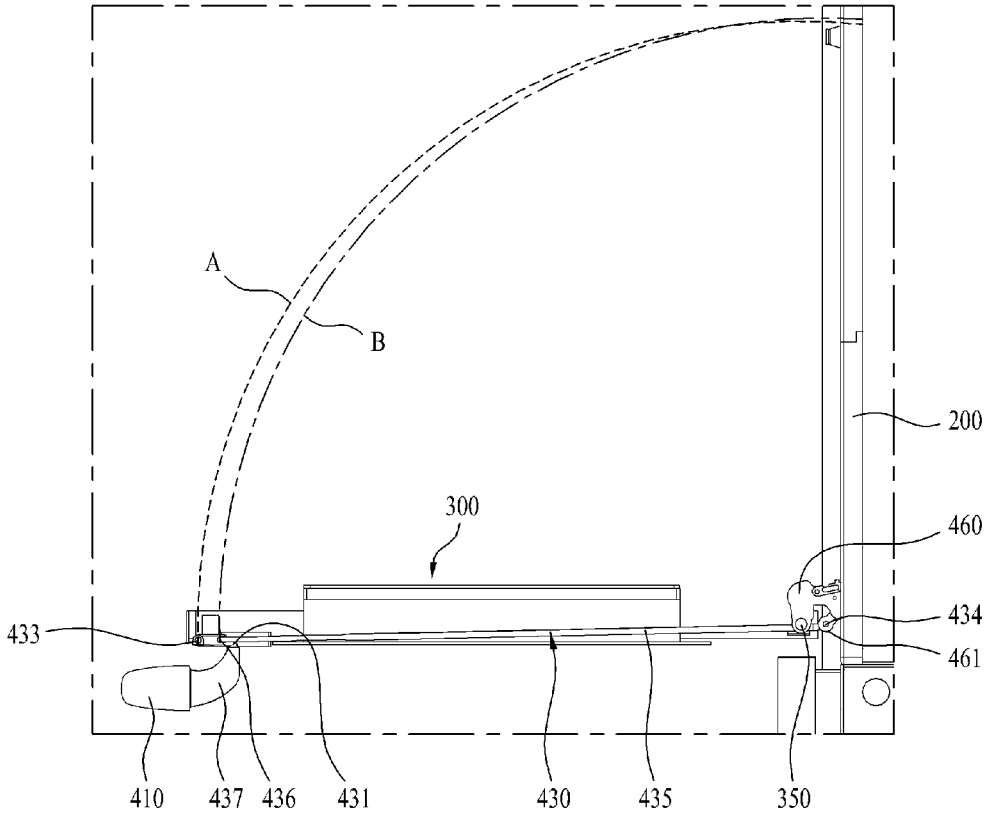
FIG. 9 is a partial sectional view illustrating an open state of the door provided in the home appliance illustrated in FIG. 5.

Hereinafter, at least one embodiment of a movement mechanism of handle 431 will be described in detail with reference to FIGS. 8 and 9.

Door 300 is opened or closed by being rotated about door rotating axis 350. Door rotating axis 350 is preferably fixed to home appliance 100. More specifically, door rotating axis 350 may be fixed to cabinet 200. Also, link rotating axis 433 is preferably fixed to door 300. As such, link rotating axis 433 is rotated along a rotation radius A as door 300 is rotated since link rotating axis 433 is fixed to door 300, preferably inside door 300.

Handle link 431 may be rotated about link rotating axis 433 as door 300 is rotated. This rotation of handle link 431 may be realized via link connector 435.

Link connector 435 may be rotated about link connector rotating axis 434 as door 300 is rotated. Preferably, link connector rotating axis 434 is fixed to cabinet 200. Preferably, link connector rotating axis 434 is spaced apart from door rotating axis 350. For example, link connector rotating axis 434 may be located behind door rotating axis 350.

As door 300 is rotated, link node 436 is rotated along a rotation radius B about link connector rotating axis 434 since link connector 435 pulls link node 436. A difference between rotation radius A and rotation radius B increases as door 300 is rotated. There is substantially no difference between rotation radius A and rotation radius B in a closed state of door 300, whereas the difference is maximized in a state in which door 300 is rotated by 90 degrees and is completely opened.

It will be appreciated that link node 436 and link rotating axis 433 are located on substantially the same rotation radius, i.e. on rotation radius A or rotation radius B, on the basis of link connector 435 in a closed state of door 300.

As described above, link rotating axis 433 is rotated along rotation radius A. In this case, link rotating axis 433 and link node 436 have a difference in the rotation radius thereof. To compensate for this difference in the rotation radius, handle link 431 begins to rotate about link rotating axis 433.

More specifically, as illustrated in FIG. 8, in a closed state of door 300, link rotating axis 433, link node 436, and link connector rotating axis 434 may be have an L-shaped arrangement. As illustrated in FIG. 9, in an open state of door 300, link rotating axis 433, link node 436, and link connector rotating axis 434 may have a substantially straight arrangement.

In other words, a distance between link rotating axis 433 and link connector rotating axis 434 may be minimized in a closed state of door 300, and may be maximized in an open state of door 300. This distance difference causes handle link 431 to be rotated, thereby causing handle 410 to be rotated.

Hereinafter, the configuration of link unit 430 will be described in detail with reference to FIG. 10.

First, the configuration of handle link 431 constituting link 430 will be described in detail.

As illustrated, handle link 431 may include an upper horizontal portion 431*a*, a vertical portion 431*b*, and a lower horizontal portion 431*c*.

Upper horizontal portion 431*a* may extend from link rotating axis 433 rearward of door 300. Upper horizontal portion 431*a* may extend in a horizontal plane parallel to handle 410, more particularly, parallel to grip portion 411.

Vertical portion 431*b* may extend downward from upper horizontal portion 431*a*. Vertical portion 431*b* may provide a vertical distance between upper horizontal portion 431*a* and handle 410.

The vertical distance means that a moment distance required to rotate door 300 may increase. That is, force required to open door 300 is applied to link rotating axis 433 other than handle 410. This means that a moment distance between link rotating axis 433 and door rotating axis 350 is greater than a moment distance between handle 410 and door rotating axis 350.

Acquisition of a greater moment distance when the same force is applied means that a greater torque may be generated. Thus, a greater moment distance may generate the same torque with less force. In this way, a moment distance may be increased owing to the shape of handle link 410, in particular, owing to vertical portion 431*b*, which may assist the user in more easily opening or closing door 300.

Lower horizontal portion 431*c* may extend forward from vertical portion 431*b*. Lower horizontal portion 431*c* may be connected to handle 410.

Vertical portion 431*b* and lower horizontal portion 431*c* may define a single curvilinear structure. That is, vertical portion 431*b* and lower horizontal portion 431*c* may be continuously connected to each other via a single connection therebetween. Of course, a lower end of horizontal portion 431*b* may be connected to lower horizontal portion 431*c* to define a single curvilinear structure.

Handle 410 is spaced apart from the front surface of door 300 in a direction perpendicular to door 300 owing to the presence of upper horizontal portion 431*a*. That is, it will be appreciated that the greater the length of upper horizontal portion 431*a*, handle 410 may be farther spaced apart from the front surface of door 300 vertically when door 300 is rotated. Also, a length of vertical portion 431*b* corresponds to a distance between handle 410 and the front surface of door 300 in a direction parallel to door 300. That is, it will be appreciated that the greater the length of vertical portion 431*b*, the greater the horizontal distance between handle 410 and the front surface of door 300 when door 300 is rotated. Thus, it will be appreciated that the greater the length of vertical portion 431*b*, the greater the length of a portion of handle 410 deviated from the range of the front surface of door 300.

Handle link 431 is rotatable. When door 300 is completely opened or closed, large shock may be applied to handle link 431 due to load of door 300 or inertial force. This is because rotation of handle link 431 may suddenly stop in the completely open state or in the closed state.

To alleviate shock applied to handle link 431, in particular, shock caused when door 300 is closed, a shock absorber 210 may be provided behind handle link 410. Shock absorber 210 may take the form of a raised bump. To increase a contact area with shock absorber 210, vertical portion 431*b* may extend parallel to a front surface of shock absorber 210. Also, a portion of link cover 437 coming into contact with shock absorber 210 may be formed parallel to the front surface of shock absorber 210. The front surface of shock absorber 210 may be a vertical surface in consideration of the fact that door 300 is closed in a vertically oriented state. In addition, shock absorber 210 may be formed at rear panel 320.

Link node 436 is preferably formed at upper horizontal portion 431*a*. In particular, link node 436 may be formed at a middle portion of upper horizontal portion 431*a* other than a distal end of upper horizontal portion 431*a*. This serves to provide a shock absorbing structure to alleviate shock transmitted to handle link 431 when door 300 is closed. That is, this serves to provide a shock absorbing space between vertical portion 431*b* and shock absorber 210.

To alleviate shock applied to handle link 431 when door 300 is completely opened, similarly, a shock absorber may be provided. In particular, according to the present embodiment, this shock absorber may be realized by upper horizontal portion 431*a* rather than the vertical portion 431*b*. This is because upper horizontal portion 431*a* is oriented parallel to front panel 310 or intermediate panel 340 of door 300 when door 300 is in a completely open state.

To this end, as shown in FIG. 5, the door panel, and more particularly, intermediate panel 340 may have a slot 343 for ingress or egress of upper horizontal portion 431*a*, and a shock absorber (not shown) may be located to correspond to slot 343.

In particular, slot 343 may serve to prevent leftward or rightward shaking of handle 410 in a completely open state of door 300. Once upper horizontal portion 431*a* has been fitted into slot 343, upper horizontal portion 431*a* has limited left and right margins, which may limit left and right margins of handle 410. Of course, the aforementioned communication apertures 312 and 342 and link cover 437 may be factors limiting left and right margins of handle 410. However, a gap between link cover 437 and communication apertures 312 and 342 may be maximized as described above in a completely open state of door 300 for the sake of smooth rotation of handle 410. Accordingly, through provision of slot 343, it is possible to effectively limit left and right margins of the handle 410. Slot 343 is preferably formed in intermediate panel 340 other than front panel 310 to provide an aesthetically pleasing outer appearance.

As described above, link node 436 is preferably formed at the middle portion of upper horizontal portion 431*a* rather than the distal end of upper horizontal portion 431*a*. This may mean that the length of upper horizontal portion 431*a* is substantially a distance between link rotating axis 433 and link node 436.

The above-described positioning of link node 436 may cause interference upon rotation of link connector 435 and handle link 431. To solve this problem, link connector 435 may include a connection loop 439. More specifically, a portion of link connector 435 adjacent to handle link 431 may have a loop shape. As such, handle link 431 and link connector 435 may be more firmly coupled to each other at both sides of link node 436 without a risk of interference. That is, at least a portion of handle link 431 may freely pass through connection loop 439.

More specifically, as illustrated in FIG. 10, a portion of a second connector of handle link 431 and a third connector may pass through an opening 439*a* of connection loop 439. In other words, vertical portion 431*b* and lower horizontal portion 431*c* may pass through opening 439*a*. As such, the connector or vertical portion 431*b* is located behind opening 439*a* in a closed state of door 300, but passes through opening 439*a* to thereby be located in front of opening 439*a* in an open state of door 300.

Accordingly, there occurs no interference between handle link 431 and link connector 435.

Figure 11:
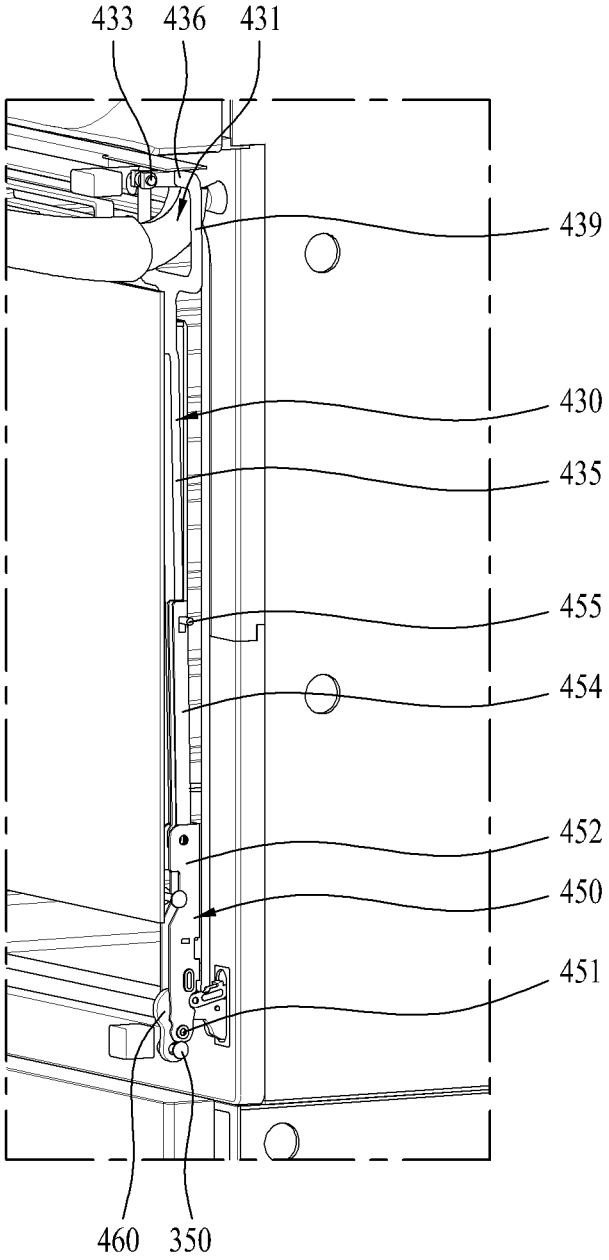
FIG. 11 is a partial sectional view of a home appliance according to another embodiment of the present invention.
Figure 12:
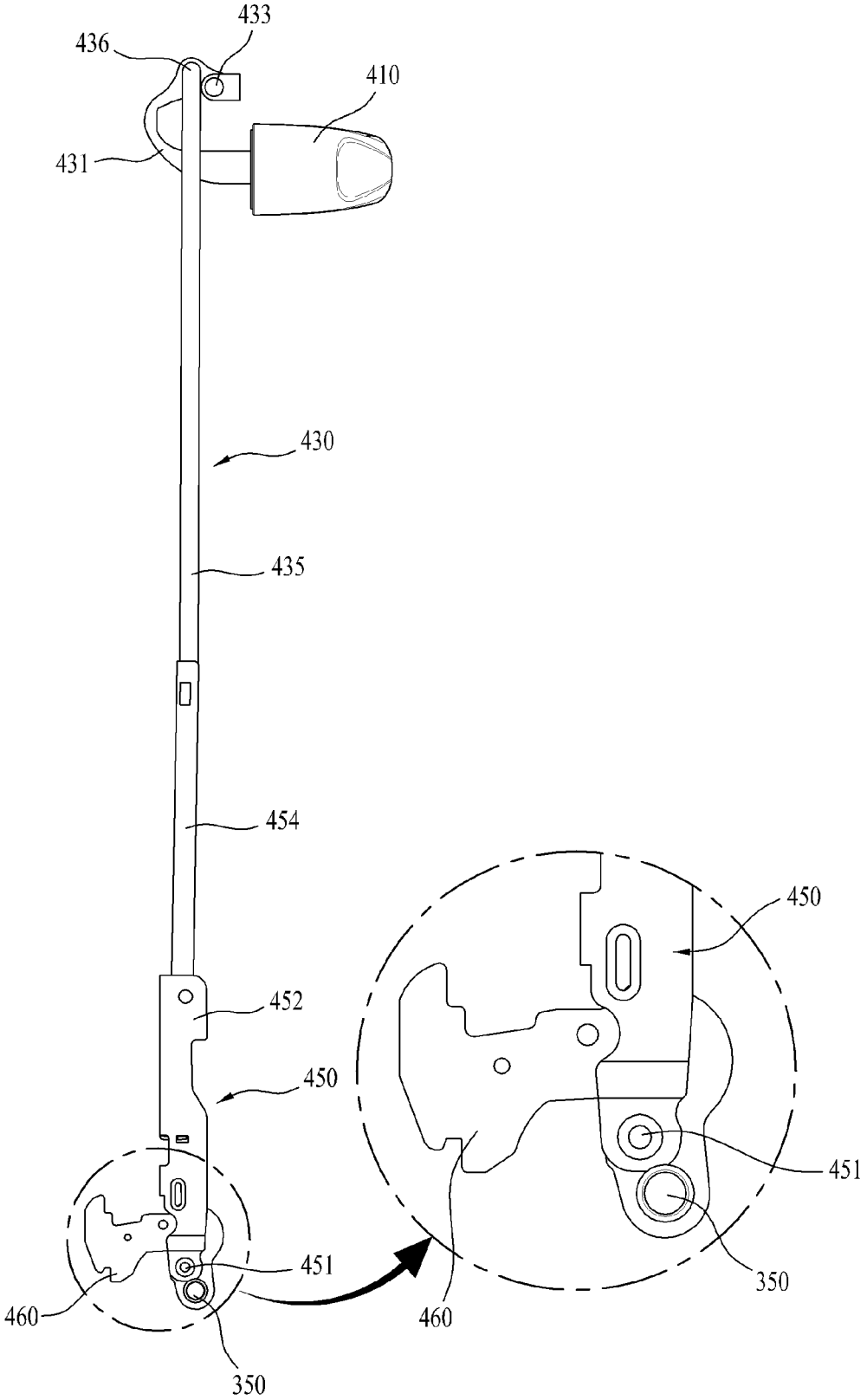
FIG. 12 is a side view of the handle and the link unit according to yet another embodiment of the present invention.

FIG. 11 and FIG. 12 illustrate another embodiment of the present invention. More specifically, FIG. 11 and FIG. 12 illustrate the embodiment of rotating handle 410 using a damper 450.

Damper 450 may serve to alleviate shock caused when opening or closing door 300 and to prevent load of door 300 from being transmitted to the user through handle 410.

Damper 450 may include a lower link 452 and an upper link 454. Lower link 452 may be rotatably connected to a first rotating axis 451 (a damper rotating axis), and upper link 454 may be rotatably connected to a second rotating axis 455. Second rotating axis 455 may be fixedly provided to door 300 and first rotating axis 451 may be provided to bracket 460.

The length of upper link 454 is getting longer as door 300 is opened since damper 450 is rotated about damper rotating axis 451. Therefore, it is possible to alleviate shock caused when opening or closing door 300 due to the damping force which is proportional to the longitudinal change rate of damper 450.

Similar to the aforementioned link connector rotating axis 434, first rotating axis 451 may be spaced apart from door rotating axis 350. As such, damper 450 may serve as the aforementioned link connector 435.

The present embodiment has a difference in that the aforementioned link connector 435 is connected to damper 450 rather than link connector rotating axis 434. In this embodiment, it is possible to replace link connector rotating axis 434 with damper rotating axis 451. More specifically, similarly, damper 450 that has been conventionally provided may create a difference in the rotation radius. Here, the conventional damper 450 is generally known and thus a detailed description thereof will be omitted.

One end of link connector 435 may be connected to upper link 454 of damper 450. Substantially, node 436 may be rotated along the aforementioned rotation radius B about first rotating axis 451. Therefore, link connector 435 pulls node 436 and the length of upper link 454 is getting longer as door 300 is opened. First rotating axis 451 may be spaced apart from door rotating axis 350.

Here, upper link 454 and link connector 435 may be formed as one body. Also, it is possible to limit the maximum length change of upper link 454 as door 300 is opened. The maximum length change of this embodiment may be smaller than that of the conventional damper. For this reason, it is possible to pull node 436 and rotate handle link 431 fully.

For example, the maximum length of damper 450 without the handle rotating function may be 25 mm. The maximum length of damper 450 of this embodiment may be 18 mm. Therefore, link connector 435 can pull node 436 by 7 mm to rotate handle 410.

Unlike the above-described embodiments, the rotation angle of door 300 may be transmitted to handle link 431 via gears, etc. For example, if door 300 is rotated by 90 degrees, handle link 431 may also be rotated by 90 degrees. Thus, providing the same gears at both sides may ensure that rotation of door 300 is directly transmitted to handle link 431.

However, when door 300 is rotated in a counterclockwise direction, handle 410 will be rotated in a clockwise direction. Thus, an arrangement of belts, pulleys or gears to allow door 300 and handle 410 to be rotated by the same angle in opposite rotation directions may be easily realized.

For example, in the case in which the gears and handle link 431 are rotated in linkage with rotation of door 300, a criss-cross belt may be provided between the gears to connect the gears to each other. In this case, one gear is rotated clockwise if the other gear is rotated counterclockwise. Through use of this configuration, handle 410 may be moved in linkage with rotation of door 300. Also, it can be said that the aforementioned configuration is within the range of the aforementioned link.

Although the above-described embodiments have described a pull-down type door, the present invention is not limited thereto. That is, the present invention may be applied to a pull-up type door or a pull-to the side type door. This is because the above-described configuration may be applied regardless of a door opening method although the door opening method may be changed according to the kinds of home appliances.

Regarding door 300 illustrated in FIG. 3, positions of handle 410 and door rotating axis 350 may be easily exchanged. If so exchanged, the resulting door 300 is of a pull-up type. In other words, an inversed configuration of the oven illustrated in FIG. 3 will be referred to as a configuration of a pull-up type door. In this case, it will be appreciated that other configurations are not changed and all the aforementioned features may be equally applied. Also, it will be appreciated that all the aforementioned effects may be equally acquired.

Similarly, assuming a configuration obtained by rotating the oven illustrated in FIG. 3 by 90 degrees, the illustrated door will be referred to as pull-to the side type door. Even in this case, similarly, it will be appreciated that other configurations are not changed and the aforementioned features or effects may be equally acquired.

According to the embodiments of the present invention, the handle always remains in the visual field of the user regardless of the type of the door, which ensures convenient opening or closing of the door.

In general, a drum type washer or dryer, for example, employs a pull-to the side type door. A refrigerator or a cabinet type refresher, similarly, employs a pull-to the side type door. A dishwasher employs a pull-down type door similar to the oven. Of course, a microwave oven or an electric or gas oven may be built in the top of the sink rather than the bottom. In this case, a pull-up type door may be employed.

In this way, the embodiments of the present invention may be applied regardless of an opening or closing method of doors and regardless of the kinds of home appliances.

As is apparent from the above description, according to an embodiment of the present invention, it is possible to provide a home appliance, which can prevent a handle from deviating from the visual field of a user when opening or closing a door, resulting in enhanced user convenience when the user opens and then closes the door.

According to at least one embodiment of the present invention, it is possible to provide a home appliance, which can prevent the wrist of a user from being bent when opening or closing a door, resulting in enhanced user convenience.

According to at least one embodiment of the present invention, it is possible to provide a home appliance in which a handle is variable in position as a door is rotated, which can eliminate a need for a user to change a hand's posture of gripping the handle in the course of opening or closing the door, resulting in enhanced user convenience.

According to at least one embodiment of the present invention, it is possible to provide a home appliance, which can be easily applied regardless of the opening or closing type of a door, resulting in easy manufacture and enhanced user convenience.

According to at least one embodiment of the present invention, it is possible to provide a home appliance in which a handle is movable dependent on and proportional to rotation of a door, which can prevent a user from confusing opening or closing of the door with movement of the handle.

According to at least one embodiment of the present invention, it is possible to provide a home appliance, which can prevent occurrence of accidents when opening or closing a door by assisting a user in continuously applying minimum force through a handle when opening or closing the door.

According to at least one embodiment of the present invention, it is possible to provide a home appliance, which can provide a handle with a greater moment distance required to rotate and opening or close a door relative to a conventional handle, thereby assisting a user in more easily opening or closing the door.

It will be apparent to those skilled in the art that various modifications and variations can be made without departing from the spirit or scope of the invention. Thus, it is intended that the various modifications and variations are covered by the appended claims and their equivalents.

What is claimed is:

1. A home appliance comprising:

a cabinet having a chamber in which an object is received or retrieved;

a door to open or close the chamber, the door having a communication aperture;

a handle rotated relative to the door during opening or closing of the door, wherein rotation of the handle causes the door to rotate about a door rotating axis; and a link unit connected to the handle, the link unit transmitting a rotation angle or rotation force of the door to the handle in accordance with rotation of the door, wherein the link unit comprises:

a handle link to rotate along with the handle; and a link unit rotating axis defining a rotation center about which the handle link is rotated, and wherein a length of the handle link outwardly exposed from a front surface of the door through the communication aperture increases as an opening angle of the door increases.

2. The home appliance of claim 1, wherein the link unit further comprises a link connector to convert rotation of the door into rotation of the handle link, or to convert rotation of the handle link into rotation of the door.

3. The home appliance of claim 2, wherein the link connector includes one end connected to a link node of the handle link and another end to rotate about a link connector rotating axis, whereby the link connector is rotated about the link connector rotating axis as the door is rotated.

4. The home appliance of claim 3, wherein the one end of the link connector is rotatably connected to the link node of the handle link.

5. The home appliance of claim 3, wherein the door rotating axis is spaced apart from the link connector rotating axis, and the handle link is rotated to compensate for a difference between a rotation radius of the link node with respect to the door rotating axis and a rotation radius of the link node with respect to the link connector rotating axis.

6. The home appliance of claim 2, further comprising a damper to alleviate shock caused during opening or closing of the door and to rotate about a damper rotating axis as the door rotates, the damper rotating axis spaced apart from the door rotating axis.

7. The home appliance of claim 6, wherein the link connector has a first end connected to the handle link and a second end connected to the damper, wherein the link connector is rotated about the damper rotating axis as the door is rotated.

8. The home appliance of claim 2, further comprising a first bracket provided to the cabinet to form the door rotating axis and a second bracket provided to the cabinet to form the link connector rotating axis, the door rotating axis and the link connector rotating axis spaced apart from each other.

9. The home appliance of claim 1, wherein the handle is rotatably connected to the door to assist a user in opening or closing the door such that a position of the handle relative to the door is variably linked with rotation of the door.

10. The home appliance of claim 1, wherein the handle is rotatably connected to the door to assist a user in opening or closing the door such that a rotation angle of the door is changed as an angle of the handle relative to the door is changed.

11. The home appliance of claim 1, wherein the door is a pull-down type door downwardly rotating and opening the door.

12. The home appliance of claim 1, wherein the rotation angle of the handle increases as the opening angle of the door increases.

13. The home appliance of claim 1, wherein the handle is outside of the front surface of the door, and the link unit rotating axis is inside of the door.

14. The home appliance of claim 1, further comprising a link cover to cover the handle link.

15. The home appliance of claim 1, wherein the handle link comprises:

a first connector extending from the link unit rotating axis rearward of the door;

a second connector extending forward of the door and connected to the handle; and a third connector located between the first connector and the second connector.

16. A home appliance comprising;

a door rotatable about a door rotating axis;

a handle rotatably provided in front of the door to assist a user in opening or closing the door;

a link unit connected to the handle and rotatable about a link connector rotating axis to transmit a rotation angle of the door to a rotation angle of the handle, the link connector rotating axis being spaced apart from the door rotating axis, wherein the link unit includes:

a handle link to rotate about a link rotating axis inside the door as the door is rotated, the handle link serving to rotate the handle about the link rotating axis, and a link connector having a first end to be rotated about the link connector rotating axis and a second end to rotate the handle link as the door is rotated; wherein a length of the handle link outwardly exposed from a front panel of the door increases as an opening angle of the door increases.

17. The home appliance of claim 16, wherein the door includes the front panel, a side panel, and a rear panel, and a horizontal distance and a vertical distance of the handle with respect to the front panel are variable as the handle is rotated.

18. The home appliance of claim 17, wherein the front panel has a communication aperture for entrance or exit of the handle link.

19. The home appliance of claim 16, wherein the link connector includes a connection loop to prevent interference during rotation of the handle link.

20. The home appliance of claim 16, wherein an attitude of the handle with respect to a base of the home appliance is fixed as the handle is rotated about the link rotating axis.

21. A home appliance comprising:

a cabinet having a chamber in which an object is received or retrieved;

a door to open or close the chamber while being rotated about a door rotating axis;

a handle at one side of the door;

a handle link connected to the handle and having a link rotating axis inside of the door so as to rotate the handle about the link rotating axis;

a link connector connected to a link node of the handle link to rotate the handle link as the link connector is rotated about a link connector rotating axis;

a first bracket on the cabinet to form the door rotating axis; and a second bracket on the cabinet to form the link connector rotating axis, the link connector rotating axis spaced apart from the door rotating axis, wherein the handle link is rotated by a difference between a rotation radius of the link node with respect to the door rotating axis and a rotation radius of the link node with respect to the link connector rotating axis as the door is rotated.

22. The home appliance of claim 21, wherein the handle link includes:

an upper horizontal portion extending from the link rotating axis rearward of the door;

a vertical portion extending downward from the upper horizontal portion; and a lower horizontal portion extending forward from the vertical portion and connected to the handle.

23. The home appliance of claim 22, wherein the link node is at a middle portion of the upper horizontal portion and performs translational movement and trajectory movement inside the door as the door is rotated.

24. The home appliance of claim 21, wherein the second bracket is separate from the first bracket.

25. The home appliance of claim 21, wherein the first bracket and the second bracket are formed as a single bracket to form both the door rotating axis and the link connector rotating axis.

* * * * *